United States Patent [19]

McCarthy et al.

[11] 4,449,330

[45] May 22, 1984

[54] RESURFACING PROCESS AND TOOL FOR INSTALLING CATRIDGE-TYPE

[76] Inventors: Cornelius J. McCarthy, 1412 Widefields, St. Louis, Mo. 63138; George E. Aplin, 888 Stacey La., Fenton, Mo. 63026

[21] Appl. No.: 368,123

[22] Filed: Apr. 14, 1982

[51] Int. Cl.[3] ..... B24B 15/00

[52] U.S. Cl. ..... 51/241 S; 51/241 VS; 51/281 R

[58] Field of Search ..... 51/241 S, 241 VS, 241 R, 51/281 R, 281 SF, 327

[56] References Cited

U.S. PATENT DOCUMENTS

| | | | |
|---|---|---|---|
| 1,283,467 | 11/1918 | Chewning | 51/241 VS |
| 1,470,679 | 10/1923 | Bellringer | 51/241 VS |
| 2,085,280 | 6/1937 | Tyler | 51/241 VS |
| 2,308,472 | 1/1943 | Smith | 51/241 VS |
| 2,412,859 | 12/1946 | Barnes . | |
| 2,431,369 | 11/1947 | Chiles . | |
| 2,631,416 | 3/1953 | Flynn | 51/241 VS |
| 3,942,289 | 3/1976 | Greer . | |
| 3,999,331 | 12/1976 | Trujillo . | |
| 4,156,326 | 5/1979 | Frost . | |

FOREIGN PATENT DOCUMENTS

| | | | |
|---|---|---|---|
| 708847 | 5/1954 | United Kingdom | 51/241 S |

*Primary Examiner*—Roscoe V. Parker

*Attorney, Agent, or Firm*—Gravely, Lieder & Woodruff

[57] ABSTRACT

A centrifugal pump is quickly and easily fitted with a cartridge-type replacement seal where its impeller shaft emerges from its casing, even though the casing is badly corroded in the region at which the seal is to fit against it. To this end, the impeller shaft is removed from the casing and stripped of its bearings, it being replaced by an arbor that carries a grinding wheel. This arbor is installed in the bearings with the grinding wheel presented toward the corroded surface of the casing. The arbor is rotated and at the same time an axially directed force is applied to it to force the grinding wheel against the corroded casing surface. The grinding wheel removes the corrosion, leaving the casing with a flat ground surface surrounding the bore through which the shaft normally extends out of the housing. The same procedure is repeated at the other end of the housing, if necessary. The arbor is then removed and replaced with the impeller shaft having the cartridge-type seals fitted to it, whereupon, the seals are bolted firmly against the ground surfaces and likewise secured to the shaft. The arbor may be fitted with bushings to accommodate shafts of varying diameter, and a lever arrangement may be employed to exert the axially directed force on the arbor.

21 Claims, 7 Drawing Figures

FIG. 3
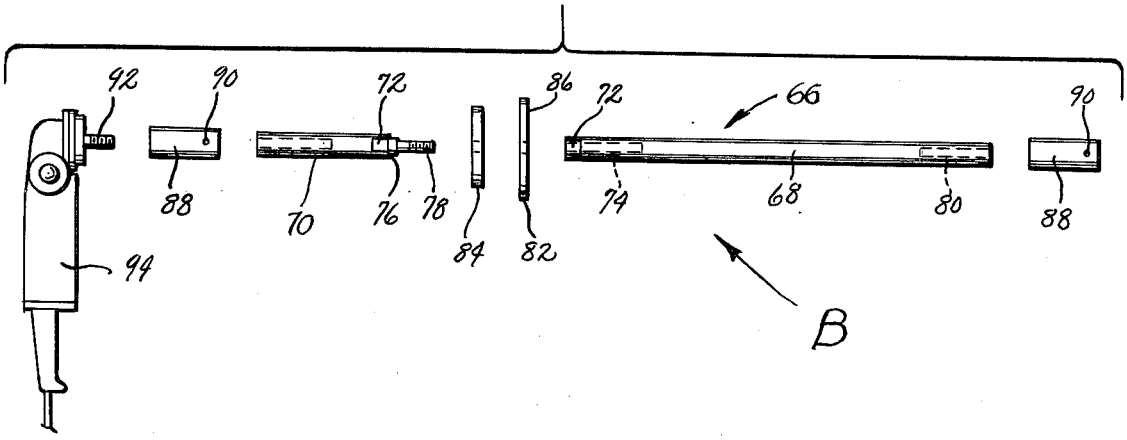
FIG. 4
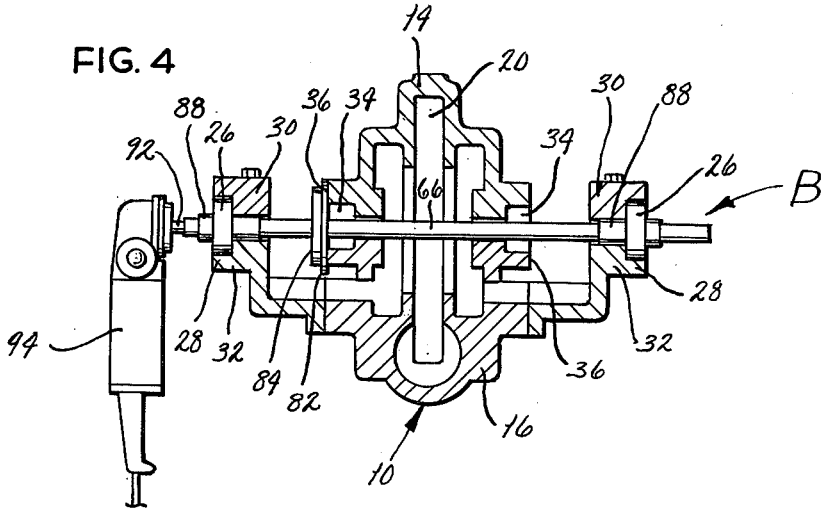
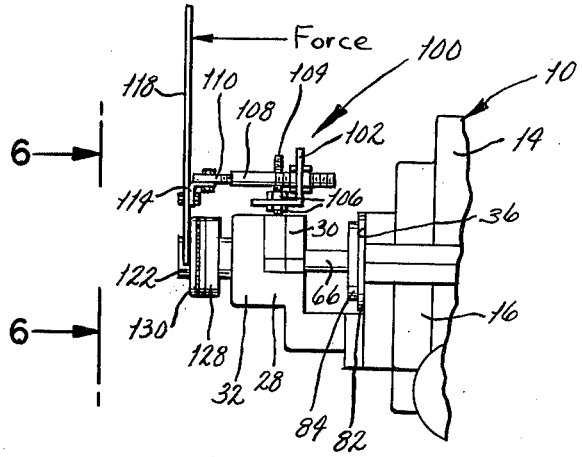
FIG. 5
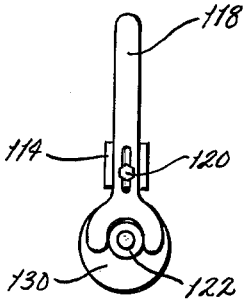
FIG. 6

RESURFACING PROCESS AND TOOL FOR INSTALLING CATRIDGE-TYPE

BACKGROUND OF THE INVENTION

This invention relates in general to seals and, more particularly, to a method of installing a cartridge-type seal on a pump or other casing through which a shaft extends and a method and tool for resurfacing such a casing.

Many pumps in operation today, particularly those for pumping water, have packing-type seals between their casings and impeller shafts. In the typical pump, the packing-type seals fit within stuffing boxes that are actually circular sockets in the casing. During operation of the pump the seals absorb a slight amount of the liquid that is circulated by the pump, and in so doing expand to create a reasonably effective barrier along the shaft and the stuffing box of the casing. Since the packing of the seals must remain moist, the seals continually leak, and although the amount of the leakage is quite small, it does occur. This causes corrosion at the stuffing boxes and on the outside of the casing. Moreover, the packing of the seals must bear against the shaft with considerable force, this force being supplied by rings or glands that are bolted tightly to the casing and around the shaft to compress the packing in the stuffing boxes. The force exerted by the packing on the shaft ultimately causes fretting and grooves to develop in the shaft.

Cartridge-type seals are currently available as replacements for the old packing-type seals, and although they are more costly than packing seals, they are considerably more durable and eliminate the foregoing problems associated with packing-type seals. The typical cartridge-type seal has a sleeve that revolves within a flange and between the two is a seal element made from an extremely durable material. The flange is attached to the casing with the same bolts that were formerly used to secure the gland that compressed the packing, there being a gasket between the two to provide a static seal. The sleeve, on the other hand, is secured to the shaft with a set screw, and to prevent leakage along the shaft surface, the sleeve contains several O-rings that bear against the shaft surface and form static seals between the inside of the sleeve and the shaft. The live seal between the rotating shaft and the stationary casing exists at the seal element which is within the flange and around the sleeve.

While cartridge-type seals may be fitted to many pumps with little effort, on others the installation is a major undertaking. In this regard, some pumps, particularly the older ones, are badly corroded in the regions of their packing-type seals, and do not provide surfaces that are flat enough or true enough to bolt the flanges of cartridge-type seals against them. In these instances, the pump must be disconnected from its supply and discharge pipes and thereafter disassembled. Its casing is further removed from the foundation on which it rests and delivered to a machine shop where it is machined in the regions surrounding its stuffing boxes so as to provide surfaces that are flat and perpendicular to the shaft axis. Thereafter, the casing is replaced on and secured to its foundation and the supply and discharge pipes are reconnected to it. Finally, the pump is assembled with the cartridge-type seals in lieu of the packing-type. This procedure consumes a considerable amount of time and requires skilled mechanics. As such it is quite costly.

SUMMARY OF THE INVENTION

One of the principal objects of the present invention is to provide a process for quickly and easily accommodating a corroded pump casing to cartridge-type seals. Another object is to provide a process of the type stated in which the pump casing, in the regions surrounding the emergence of a shaft from it, is provided with flat surfaces that are squared off with respect to the axis of the shaft. A further object is to provide a process of the type stated in which the flat surface is formed without removing the pump from its foundation or disconnecting it from its supply and discharge pipes. An additional object is to provide a tool for performing the process of the type stated. These and other objects and advantages will become apparent hereinafter.

The present invention resides in a process for resurfacing the casing of a machine having a shaft extending from the casing so that the casing will accommodate a cartridge-type seal. The process involves substituting an arbor for the shaft, grinding the casing with a grinding wheel that is on the arbor, and thereafter removing the arbor and replacing it with the shaft. The invention also resides in the foregoing process utilized to fit the machine with a cartridge-type seal, in which case the seal is fitted to the shaft as part of the installation of the shaft back in the housing. In addition, the invention resides in an arbor having sections, means for coupling the sections together, and a grinding wheel clamped between the two sections in the region where they couple together. The invention further resides in a tool including an arbor and a grinding wheel on the arbor, and also means capable of being mounted on the pump for applying an axially directed force to the arbor. The invention also consists in the parts and in the arrangements and combinations of parts hereinafter described and claimed.

DESCRIPTION OF THE DRAWINGS

In the accompanying drawings which form part of the specification and wherein like numerals and letters refer to like parts wherever they occur:

FIG. 3 is an exploded view of the tool for grinding the sealing surface on the pump;

FIG. 4 is a sectional view of the pump with the grinding tool installed in it;

FIG. 5 is an elevational view of tool modification that enables the tool to apply an axially directed force to the arbor that carries the grinding wheel so as to force the grinding wheel against the sealing surface of the pump;

FIG. 6 is an end elevational view of the thrust-applying tool taken along line 6—6 of FIG. 5.

DETAILED DESCRIPTION

Figure 1:
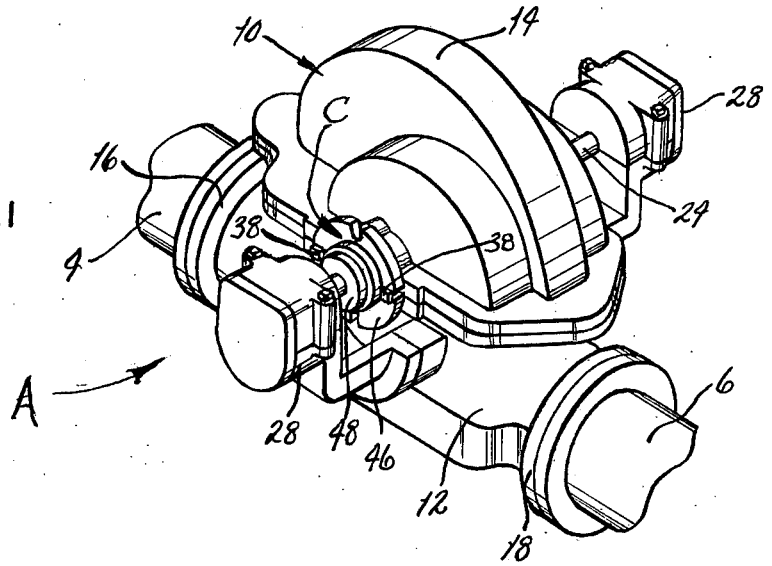
FIG. 1 is a perspective view of a pump fitted with cartridge-type seals after sealing surfaces on the pump have been refinished in accordance with the process of the present invention.

Referring now to the drawings, a centrifugal pump A (FIG. 1) is resurfaced on its casing with a resurfacing tool B (FIG. 3) so that the pump A may be fitted with cartridge-type seals C (FIG. 2) in lieu of common packing seals. While the tool B and the process by which it is utilized are suitable for resurfacing the casings or housings of a wide variety of machinery, they will be described in conjunction with the centrifugal pump A, for the tool B and process probably have their greatest utility in connection with repairs to such pumps.

To understand the tool B and the process in which it is employed requires an understanding of the centrifugal pump A. The pump A (FIGS. 1 & 2) is mounted upon a solid foundation (not shown) and is connected with a supply pipe 4 and a discharge pipe 6 for circulating a liquid, most likely water, through those pipes. The pump A includes a split casing 10 having a lower section 12 and an upper section 14 that are bolted together along a fluid-tight interface. The lower section 12 rests on the foundation and has a flanged inlet port 16 and a flanged outlet port 18 that are bolted respectively to the supply pipe 4 and discharge pipe 6. The casing 10 encloses a cavity 20 in which an impeller 22 (FIG. 2) revolves, and the impeller 22 is mounted securely on a shaft 24 that extends out of both ends of the casing 10. Beyond the casing 10 the impeller shaft 24 fits into bearings 26 that are contained in bearing housings 28 which, like the casing 20, are split so as to have upper and lower sections 30 and 32. The lower sections 32 of the bearing housings 28 are bolted firmly to the lower section 12 of the casing 10, while the upper sections 30 are bolted to their respective lower sections 32, and thus the bearings 26 are captured within the bearing housings 28.

Figure 2:
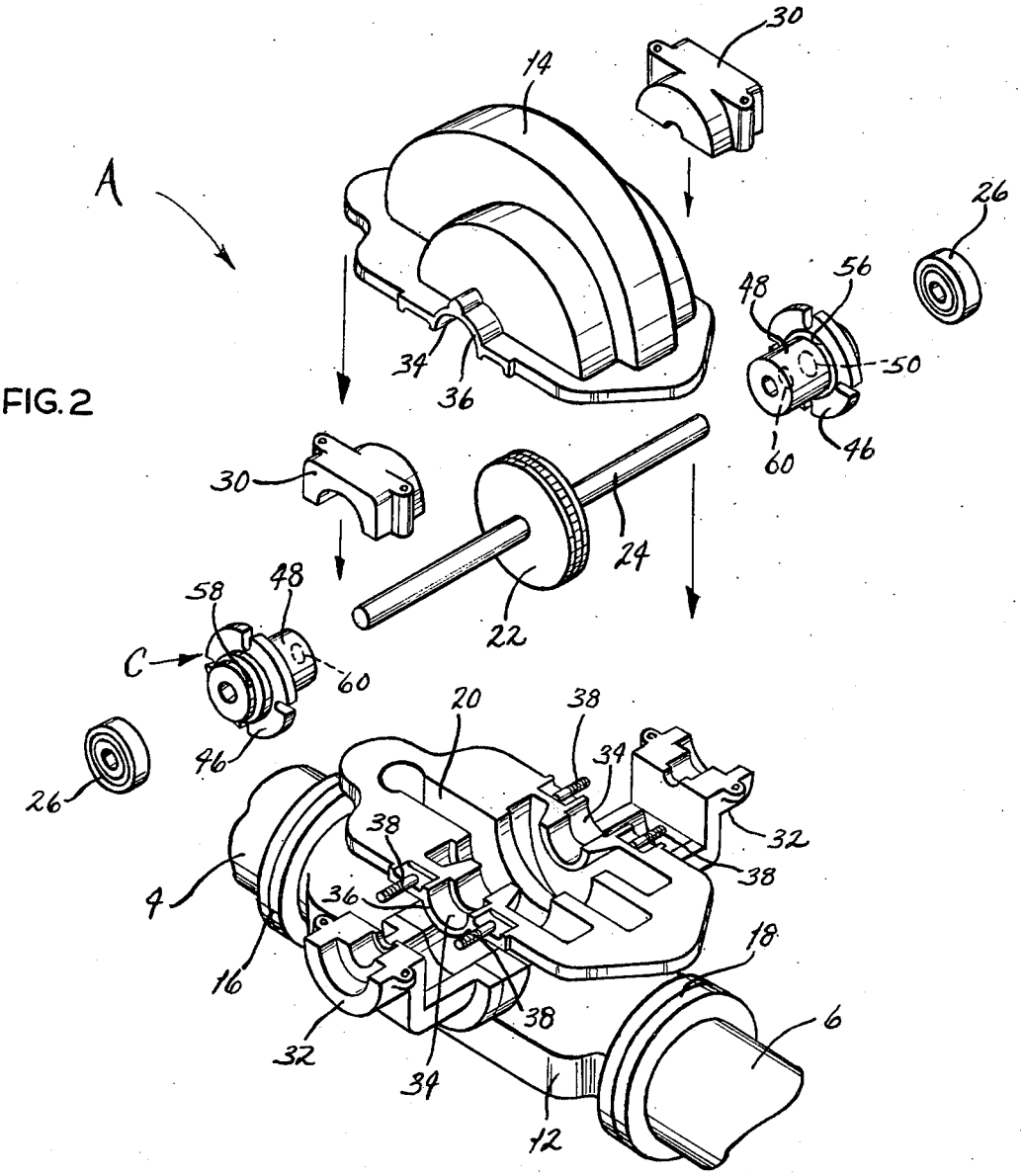
FIG. 2 is an exploded perspective view of the pump.

The parting surfaces between the upper and lower sections 12 and 14 of the casing 10 and the parting surfaces between the upper and lower sections 30 and 32 of the bearing housings 28 lie in a common plane that passes through the axis of the shaft 24. Thus, when upper section 12 of the casing 10 and the upper sections 30 of the bearing housings 28 are removed, the shaft 24, along with the impeller 22 and bearings 26, may be merely lifted from the lower sections 14 and 32 (FIG. 2).

Where the impeller shaft 24 emerges from the casing 10, the casing 10 has stuffing boxes 34 (FIGS. 2 & 4) which are actually outwardly opening sockets that are concentric to the shaft 24, and surrounding the stuffing boxes 34 are end surfaces 36 which are relatively smooth, but nevertheless are usually not machined. Moreover, at each end surface 36, two stud bolts 38 project from the casing 10, one on each side of the shaft 24 (FIG. 2).

The stuffing boxes 34 are designed to hold packing-type seals (not shown) which are compressed in the stuffing boxes 34 by glands (not shown) that are in turn forced against the packing-type seals by nuts that are threaded over the stud bolts 38. Despite the tightly compressed packing-type seals, water still escapes through and along the seals, and in time this water will corrode the casing 10, most significantly in the regions directly below the stuffing boxes 34. Indeed, the corrosion leaves deep pits or discontinuities in the otherwise smooth surfaces 36 surrounding the stuffing boxes 34.

The cartridge seals C serve as replacements for the packing-type seals supplied originally with the pump A. Actually the cartridge-type seals C replace both the packing-type seals and the glands that hold them in place, and are indeed fastened to the ends of the casing 10 by the stud bolts 38 which formerly secured the glands. Cartridge seals C are available from several manufacturers, one being A. W. Chesterton Co. of Stoneham, Massachusetts. Since the cartridge seals C are readily available items of commerce, they will only be described to the extent of their basic components.

Each cartridge-type seal C (FIG. 2) includes a flange 46, a sleeve 48 that fits through the flange 46 such that it can rotate relative to the flange 46, and seal elements 50 which contact wear surfaces and establishes fluid-tight barriers between the flange 46 and sleeve 48 despite relative motion between the two. In other words, a live or moving interface exists between the seal elements 50 and the wear surfaces against which they bear.

The flange 46 is bolted against the casing 10, and to this end it is provided with radially directed slots 54 which will align with the stud bolts 38 that project from the casing 10. On its back face, that is the face which is presented toward the casing 10, the flange 46 is fitted with a gasket ring 56 (FIG. 2) that is designed to seat against the end surface 36 that surrounds the stuffing box 34 in the casing 10. When nuts are threaded over the stud bolts 38 and tightened down against flange 46 (FIG. 1), the gasket 56 is compressed tightly between the flange 46 and the end surface 36 so as to create a fluid-tight barrier between the two, assuming of course that surface 36 is not badly corroded and therefore flat enough to accommodate the seal C.

The sleeve 48 fits around the shaft 24 and within the flange 46, projecting axially beyond both ends of the flange 46. The inwardly projecting portion extends into the stuffing box 34 that was formerly occupied by the packing-type seal. The outwardly projecting portion contains a set screw 58 (FIG. 2) which, once the sleeve 48 is at the proper location on the shaft 24, is tightened down against the shaft 24 to fasten the sleeve 48 firmly on the shaft 24. In addition, the sleeve 48 contains several O-rings 60 that bear against the surface of the shaft 24 and establish a fluid-tight barrier between the shaft 24 and sleeve 48.

Thus, it can be seen that if the seals C are to operate effectively on the pump A, the surfaces 36 that surround the sockets 34 in the casing must be reasonably flat and free of discontinuities. Otherwise, the gaskets 56 will not form effective barriers against the casing 10. The tool B refinishes badly corroded surfaces 36 so that they are flat and perpendicular to the axis of the shaft 24. In effect, the tool B converts a badly corroded sealing or end surface 36 into a flat machined surface 36 that completely surrounds the stuffing box 34. As such the gasket 56, when compressed against the machined surface 36 will create a fluid-tight barrier.

The tool B consists of an arbor 66 (FIG. 3) having long and short sections 68 and 70 of equal diameter, that diameter being equal to the inside diameter of the two bearings 26. Actually the diameter of the two sections 68 and 70 is slightly smaller than the inside diameter of the two bearings 26 so that the arbor 66 can be inserted into and removed from the bearings 26 with ease. Both end faces of the long section 68 are squared off with respect to the axis of that section. At its one end the long section 68 is provided with a pair of lands 72, and opening out of the squared off end face at that end is a threaded bore 74 that is coaxial with the section 68. The short section 70 at one end has a shoulder 76 from which a threaded spindle 78 projects axially. The threads of the spindle 78 are configured to engage the threads of the bore 74, so that the two sections 68 and 70 may be coupled to form the arbor 66. To this end the short section 70 is likewise provided with lands 72, and thus each section 68 and 70 may be engaged with a conventional end wrench and turned. At their opposite ends the long and short sections 68 and 70 have identical threaded bores 80 which open out of the end faces at those ends and are likewise coaxial. The threaded bores 80 are designed to receive the rotatable spindle 92 on a conventional power tool such as a grinder 94 of the type used in automotive body work.

In addition to the arbor 66, the tool B includes a grinding wheel 82 and a steel backing disk 84, the former being slightly larger in diameter than the latter. Both have center holes which are slightly larger than the threaded spindle 78 so that they will fit over the spindle 78. Indeed, the backing disk 84 is installed over the spindle 78 and against the shoulder 76 and then the grinding wheel 82 is placed over the spindle 78. Next the spindle 78 is threaded into the bore 74 in the long section 68 and the two sections 68 and 70 are tightened down against the wheel 82 and disk 84, preferably by using end wrenches that are fitted over the lands 72. Thus, the wheel 82 and backing disk 84 are clamped tightly between the shoulder 76 on the short section 70 and the squared off end face on the long section 68 (FIG. 4). The wheel 82 on its side that is presented away from the disk 84 has a flat grinding face 86 that is perpendicular to the axis of the arbor 66.

Finally, the tool B is equipped with a series of bushings 88 (FIG. 3) that fit easily over the long and short sections 68 and 70 of the arbor 66 and enable the arbor 66 to fit bearings of different sizes. In this regard, the bushings 88 are provided in pairs with the outside diameter of the bushings 88 for each pair being sized to fit the bore of the inner races for a specific set of bearings. Thus, if the arbor 66 is smaller than the bores of a set of bearings 26, bushings 88 that fit those bores selected and are installed over the long and short sections 68 and 70. Each bushings 88 contains a set screw 90 which, when turned down, bears against the corresponding section 68 or 70 of the arbor 66 and thereby secures the bushing 88 to the arbor 66.

If the pump is badly corroded on either or both of the end surfaces 36 surrounding the stuffing boxes 34 in its casing 10, the tool B may be used to machine the corroded surface 36 so that it is flat around the entire circumference of the box 34 and so that it is further normal to the axis of the impeller shaft 24. This, of course, enables the gasket 56 of a cartridge-type seal C to seat against the casing 10 of the pump A without any leakage between the flange 46 of the seal C and the machined end surface 36 of the casing 10.

To install the cartridge-type seals C on a pump A having badly corroded surfaces 36, the pump A is first partially disassembled. In particular, the bolts securing the upper section 14 of the casing 10 to the lower section 12 are withdrawn and the upper section 14 is lifted from the lower section 12. Then the upper sections 30 of the two bearing housings 28 are also removed from their corresponding lower sections 32, again by withdrawings the bolts that hold them in place, and this exposes the bearings 26. Also, the nuts that hold the glands for the packing-type seals in place are removed and the glands are withdrawn from the stud bolts 38. This frees the impeller shaft 24 and enables it and the impeller 22 to be removed from the lower section 12 of the casing 10 which is done merely by lifting the shaft 24 out of the lower section 12. Of course, the bearings 26 come with the shaft 24. The bearings 26 are next stripped from the impeller shaft 24 and the same holds true with regard to the glands and to any packing-type seals that cling to the shaft 24. Finally, the portions of the stuffing boxes 34 on both the upper and lower sections 12 and 14 are cleaned to remove remnants of the packing-type seal.

Assuming that the arbor 66 is assembled with the backing disk 84 and grinding wheel 82 clamped between its long and short sections 68 and 70, the tool B is then installed in the casing 10 in the place formerly occupied by the impeller shaft 24 (FIG. 3). More specifically, the bearings 26, or replacements for those bearings 26, are fitted over the long and short sections 68 and 70 of the arbor 66. If the bores for the inner races of the two bearings 26 are larger in diameter than the diameter of the arbor 66, appropriate bushings 88 are fitted over the long and short sections 68 and 70 of the arbor 66 to accommodate the bearings 26 to the arbor 66. Next, the bearings 26 are aligned with the lower sections 32 of the bearing housings 28, which sections remain bolted to the lower section 12 of the pump casing 10. The shaft 66 is then lowered into the position formerly occupied by the impeller shaft 24, while at the same time the grinding wheel 82 is maneuvered such that its grinding surface is located opposite to the corroded surface 36 at one end of the lower section 12 of the pump casing 10. In this regard, the arbor 66 slides with relative ease within the bearings 26 so that the axial position of the grinding wheel 82 can be altered with little effort. Next, the upper sections 30 of the two bearing housings 28 are bolted to their corresponding lower sections 32 so as to clamp the bearings 26 securely within their respective bearing housings 28. Finally, the upper section 14 of the pump casing 10 is aligned with and lowered onto the lower section 12, whereupon the two sections 12 and 14 are bolted together, at least at a few of the bolt holes on each side of the pump cavity 20.

To complete the set up, the power-type grinder 94 is connected to the arbor 66 at the threaded bore 80 which opens out of the short section 70 of the arbor 66. This involves merely threading the driven spindle 92 of the grinder 94 into the bore 80 of the arbor 66.

The tool B is now in position to face the corroded end surface 36 opposite to which the flat grinding face 86 of the grinding wheel 82 is disposed. Indeed, the power grinder 94 is merely energized and it turns the arbor 66 about the axis of the bearings 26 which during normal operation of the pump A is the axis of rotation for the impeller 22 and its shaft 24. As the arbor 66 and the grinding wheel 82 revolve, an axial force is exerted on the power grinder 94 in the direction which forces the flat grinding face 86 of the grinding wheel 82 against the corroded surface 36 of the casing 10. As a consequence, the grinding wheel 82 bears against the casing 10 and grinds the surface 36. The grinding continues until a smooth end surface 36 extends around the entire stuffing box 34. This eliminates much of the corrosion and provides a smooth machined surface 36 against which the gasket 56 of the cartridge-type seal C may seat.

Once the surface 36 at one end of the casing 10 is finished, the upper section 14 of the casing 10 is again removed, as are the upper sections 30 of the two bearing housings 28. The arbor 66 along with the bearings 26 on it are lifted from the casing 10 and reversed so that the grinding wheel 82 now locates opposite the other end surface 36, that is the surface 36 that surrounds the stuffing box 34 at the other end of the casing 10. Again, the casing 10 is reassembled as are the bearing housings 28 and the other end surface 36 is ground until it is likewise flat around the entire stuffing box 34.

In lieu of disassembling the casing 10 and the two bearing housings 28, the arbor 66 may be separated to place the grinding wheel 82 opposite the other end surface of the casing 10. In particular, the long section 68 and the short section 70 are turned relative to each other such that the two sections 68 and 70 unthread and detach from each other at the threaded spindle 78. Then the short section 70 is withdrawn from the bearing 26 through which it passes, and likewise the long section 68 is withdrawn from its bearing 26 and the casing 10 as well. The grinding wheel 82 and backing disk 84 are then collectively moved to the opposite end face 36, whereupon the arbor 66 is reassembled by inserting the long and short sections 68 and 70 through the bearing 26, opposite to the ones in which they were formerly located and then threading them together at the repositioned grinding wheel 82 so that the grinding wheel 82 is again captured between the two sections 68 and 70 with its grinding face 86 located opposite the other end face 36 on the casing 10.

When the other end surface 36 is completed, the upper section 14 of the casing 10 and likewise the upper section 30 of the bearing housings 28 are again removed and the bearings 26 are further withdrawn from the arbor 66 and placed on the impeller shaft 24, but only after the cartridge seals C have been fitted over the shaft 24 (FIG. 2). Then, the impeller shaft 24 with the cartridge seals C and bearings 26 on it is replaced in the lower section 12 of the casing 10, and the lower sections 32 of the bearing housings 28. In so doing, the impeller 22 drops into the pump cavity 20, whereas the bearings 26 fit into the bearing seats on the lower sections 32 of the bearing housings 28. The cartridge-type seals C, on the other hand, fit into the spaces between the ends of the casing lower section 12 and the lower sections 32 of the bearing housings 28. Thereafter, the casing upper section 14 is installed on the casing lower section 12, but before it is clamped in place the stud bolts 38 are fitted between the two sections 12 and 14 so that they project axially beyond the two machined surfaces 36 at each end of the casing 10. Thereupon, the casing upper section 14 is bolted firmly to the casing lower section 12, while the upper sections 30 of the bearing housings 28 are fitted to their corresponding lower sections 32 and bolted firmly in place so that the bearings 26 are captured within the bearing housings 28. Next, the flanges 46 of the two cartridge-type seals are rotated until the slots 54 in those flanges align with the stud bolts 38 that project from the casing 10, whereupon the cartridge-type seals C are moved over the impeller shaft 24 to bring the flanges 46, or at least the gaskets 56 along the flanges 46, against the machined end surfaces 36 at the ends of the casing 10. The stud bolts 38 project through the flanges 46, and nuts are threaded over the bolts 38 and turned down against the flanges 46. Indeed, the nuts are tightened to compress the gaskets 56 sufficiently to form fluid-tight seals between the machined casing surfaces 36 and the backs of the flanges 46.

The O-rings within the sleeves 48 of the two seals, of course, establish fluid-tight barriers between the sleeves 48 and the impeller shaft 24. The sleeves 48 are secured firmly to the shaft 24 by turning down the set screws 58.

The pump A is now in condition for operation and is sealed much more efficiently in the regions where the impeller shaft 24 emerges from the casing 10, the more effective sealing, of course, being provided by cartridge-type seals C.

By using the tool B, the pump A is restored to an operative condition with a minimal amount of effort and time. In this regard, the process does not require removing the pump A, or more specifically, the lower section 12 from its foundation or detaching it from its supply and discharge pipes 4 and 6. Hence, the gaskets at the flanged fittings on the pipes 4 and 6 are not disturbed. Further, there is no requirement to transport the heavy pump casing 10 to a machine shop or to engage in the difficult procedure of positioning the pump in a machine tool such that the surfaces 36 will be refinished perpendicular to the impeller shaft 24.

Figure 7:
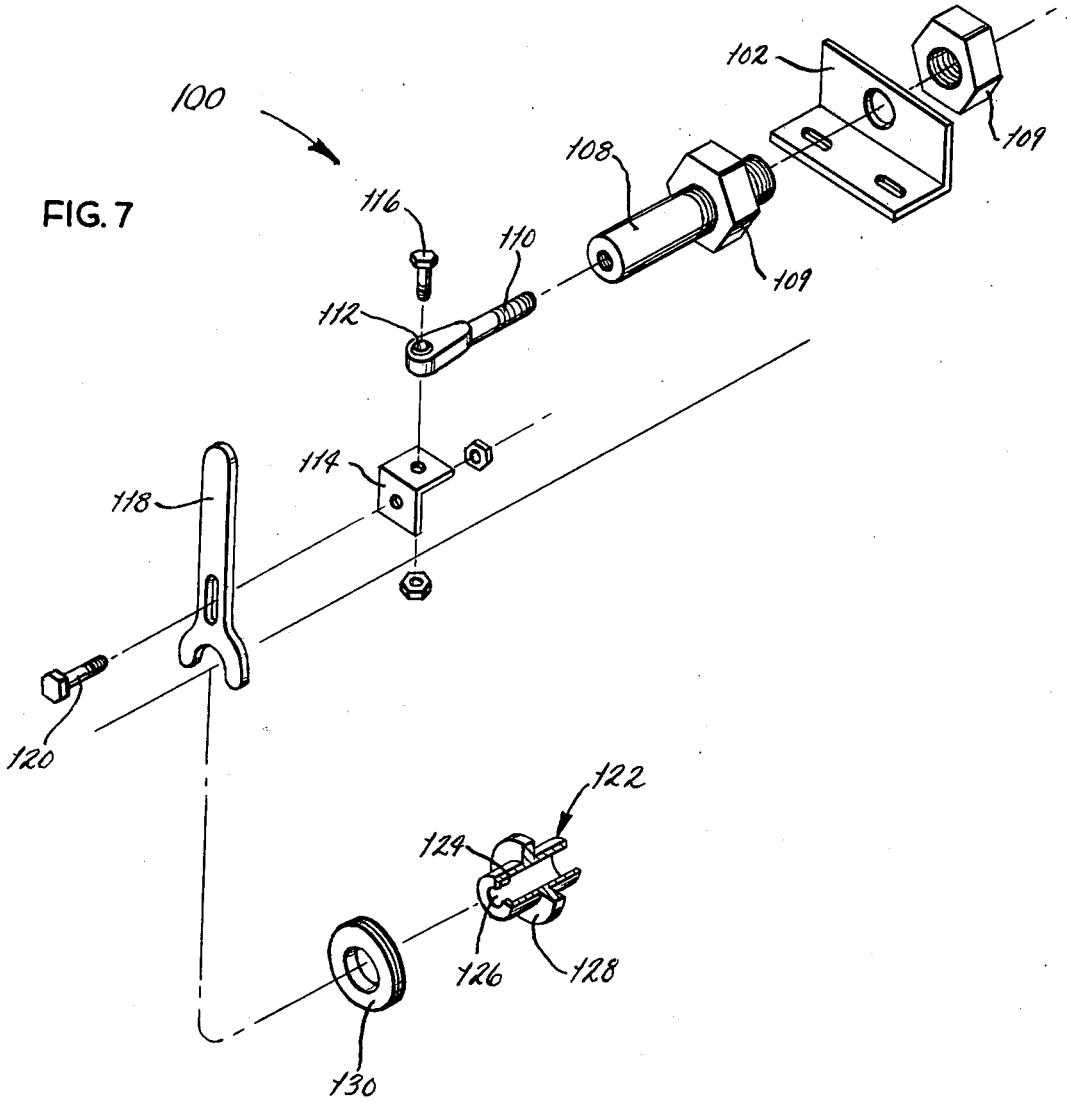
FIG. 7 is an exploded perspective view of the thrust-applying tool.

The axial force that is applied to the arbor 66 so as to urge the grinding wheel 82 against the corroded surface 36 of the casing 10 requires a considerable amount of effort on the part of the operator of the power-type grinder 94 which is attached to the arbor 66, and furthermore places the bearings of the grinder 94 under a heavy thrust load. The amount of physical effort may be reduced considerably and likewise the thrust load on the power-type grinder may be essentially eliminated, when a thrust applicator 100 (FIGS. 5–7) is used in conjunction with the arbor 66, in which case applicator 100 likewise forms part of the resurfacing tool B.

The thrust applicator 100 includes (FIGS. 5 & 7) a mounting bracket 102 that fits over the upper section 30 of one of the bearing housings 28, usually the one opposite to the casing surface 36 that is to be resurfaced. The normal cap screws that hold the upper and lower sections 30 and 32 of the housing 28 together are set aside and replaced by threaded rods 104 (FIG. 5) which extend through the upper section 30 and thread into the lower section 32. Over each rod 104 several nuts 106 are threaded. The lowermost nut 106 on each rod 104 is turned down against the upper section 30 of the housing 28 and clamps it tightly against the lower section 32 so that the bearing 26 is captured within the bearing housing 28. The remaining nuts 106 on each rod are tightened down against the mounting bracket 102 to hold it, or more accurately, to clamp it in a fixed position above the housing 28.

Extended from the bracket 102 generally parallel to the arbor 66 is a thrust bar 108 (FIG. 7) which actually projects through the bracket 102, where it is externally threaded secured to the bracket 102 by double nuts 109. Threaded into the opposite end of the bar 108 is an eye bolt 110 which carries a spherical fitting 112 that is located generally above the end of the arbor 66, the eye bolt 110 and the spherical fitting being commonly known as a Heineman fitting. The spherical fitting 112 has another bracket 114 attached to it by means of a bolt 116, and the fitting 112 enables the bracket 114 to pivot universally with respect to the underlying arbor 66. The bracket 114, in turn, carries a forked lever 118 which is secured to it by a bolt 120 such that the lever 118 can be adjusted upwardly and downwardly on the bracket 114. Indeed, the lever 118 is adjusted such that the tines at its forked end are located on opposite sides of that end of the arbor 66 which extends from the bearing housing 28 over which the mounting bracket 102 is positioned. The opposite end of the lever 118, serves as a handle and projects above the eye bolt 110 and thrust bar 108.

The forked lever 118 is in effect supported on the bearing housing 28 of the pump A by means of the bracket 114, eye bolt 110, bar 108 and mounting bracket 102 (FIG. 5), with all of the foregoing components containing adjustments that enable the forked end to assume the proper position with respect to the arbor 66. In addition, the thrust applicator 100 includes a collar 122 (FIG. 7) which fits over the end of the arbor 66 adjacent to the bearing housing 28. One end of the collar 122 has a shoulder 124 which abuts against the end of the arbor 66, but the shoulder 124 has an aperture 126 that exposes the threaded bore 80 in the end of the arbor section 68 or 70 over which the collar 122 is fitted. Thus the spindle 92 of the power-type grinder 94 may be extended through the aperture 126 and threaded into the arbor 66. Likewise, a cap screw may be extended through the aperture 126 and threaded into the bore 80 at the end of the arbor merely to secure the collar 122 to the end of the arbor 66. Midway between its ends the collar 122 has a flange 128 and the outside diameter of the collar 122 on each side of the flange is equal. Indeed, that diameter is smaller than the space between the tines of the forked lever 118 (FIG. 6). The collar 122 serves as a carrier for a thrust bearing 130 which fits around the collar 122 and against its flange 128, all such that the tines of the forked lever 118 are located on the one side of the bearing 130 and the flange 128 on the other (FIG. 5). Thus, one by grasping the handle of the lever 118 can exert a force on the thrust bearing 130 which in turn transmits that force to the flange 128 on the collar 122. The collar 122 in turn transmits the force to the arbor 66 which urges the grinding wheel 82 against the end surface 36 of the casing 10.

Thus, by using the thrust applicator 100, an axially directed force of considerable magnitude is applied to the arbor 66 without significant physical exertion and without transmitting the axially directed force through the power grinder 94 which turns the arbor 66.

The thrust applicator 100 is constructed such that it can apply the axially directed force in either direction and from either end of the arbor 66. In other words, it may be mounted upon either bearing housing 28 and from those locations may exert an axial force in either direction. Of course, when applied in one direction the thrust bearing 130 and forked lever 118 are on one side of the flange 128 for the collar 122 and when applied in the other direction the thrust bearing 130 and forked lever 118 are on the other side of the flange 128. Moreover, the power-type grinder 94 which turns the arbor 66 may be attached to either end of the arbor 66 irrespective of whether that end has the collar 122 fitted over it.

This invention is intended to cover all changes and modifications of the example of the invention herein chosen for purposes of the disclosure which do not constitute departures from the spirit and scope of the invention.

What is claimed is:

1. A tool for resurfacing the surface of a pump casing where a shaft, that is supported on bearings, emerges from the casing, said tool comprising: an arbor adapted to fit into the pump casing in lieu of the shaft; a grinding wheel carried by the arbor and configured to locate opposite the surface of the casing that is to be resurfaced; means connected to the arbor for rotating the arbor, and thrust applying means capable of being mounted upon the pump for exerting an axially directed force on the arbor as it rotates, with the force being oriented such that the grinding wheel is urged against the casing for resurfacing the casing in the region where the shaft normally emerges from the casing, the thrust applying means including a mount that is capable of being attached securely to the pump, a lever that pivots on the mount, and means for coupling the lever and the arbor such that a force exerted on the lever is transmitted into an axially directed force on the arbor.

2. A tool according to claim 1 wherein the means for coupling the lever and the arbor includes a flange surrounding the arbor and mounted in a fixed position thereon, and a thrust bearing between the flange and the end of the lever.

3. A tool according to claim 2 wherein that end of the lever that is at the thrust bearing is forked such that it contacts the thrust bearing on each side of the shaft.

4. A tool according to claim 3 wherein the flange is on a collar which fits over the end of the arbor, and the thrust bearing is on the collar.

5. A tool according to claim 1 wherein the mount for the thrust applying means is adapted and attached to a housing that is mounted upon the pump casing and contains a bearing that supports the shaft and the arbor as well.

6. A process for installing a cartridge-type seal on a machine that has a shaft which emerges from a casing and bearings located in mounts that are fixed in positioned with respect to the casing to enable the shaft to rotate within the casing, the seal including a flange adapted to fit against a sealing surface located on the casing where the shaft emerges from the casing, a sleeve located within the flange and adapted to fit over the shaft and means for creating a fluid-tight seal between the flange and sleeve while one turns relative to the other, said process comprising: removing the shaft from the casing; replacing the shaft with an arbor that carries a grinding wheel and turns in bearings, with the grinding wheel being presented opposite to a sealing surface of the casing that normally surrounds the shaft where the shaft emerges from the casing and the bearings being in the mounts normally occupied by the bearings of the shaft; rotating the arbor and simultaneously exerting a force on it, with the force being directed such that it urges the grinding wheel against the sealing surface of the casing so as to grind a generally continuous surface on the casing; removing the arbor and grinding wheel from the casing; installing the cartridge-type seal on the shaft; installing the shaft in the casing and the shaft bearings in their mounts; and securing the flange of the cartridge-type seal opposite the machined sealing surface of the casing so that a fluid-tight joint exists between the two.

7. The process according to claim 6 wherein the step of installing the shaft in the casing further includes removing the bearings from the arbor and fitting them to the shaft.

8. The process according to claim 6 wherein the casing is split and includes a fixed section and a removable section; wherein the step of removing the shaft from the casing and the step of removing the arbor and grinding wheel from the casing include detaching and separating the removable section from the fixed section; and wherein the step of replacing the shaft with an arbor and the step of installing the shaft in the casing include fitting and securing the removable section to the fixed section.

9. The process according to claim 8 wherein the bearings are contained within bearing housings that are attached to the casing; and the step of removing the shaft from the casing and the step of removing the arbor and the grinding wheel from the casing include separating the bearings from their housings; and wherein the step of replacing the shaft with an arbor and the step of installing the shaft in the casing include fitting the bearing to the bearing housing.

10. The process according to claim 9 wherein the arbor has a diameter smaller than that of the shaft, and wherein the step of fitting the arbor with the bearings further includes installing bushings over the shaft to accommodate the bearings.

11. The process according to claim 6 wherein the arbor is small enough to slide axially through the bearings with relative ease.

12. The process according to claim 11 wherein that surface of the grinding wheel which is brought against the casing is normal to the axis of the arbor, whereby the sealing surface is ground perpendicular to the axis of the shaft.

13. A process for fitting a machine having a casing and a shaft that emerges from the casing with a cartridge-type seal in the region where the shaft emerges from the casing, the machine further having bearing housings on the casing and bearings which are in the housings and support the shaft on the casing, the cartridge-type seal including a flange that is adapted to fit against a sealing surface located on the casing where the shaft emerges from the casing, a sleeve located within and capable of rotating relative to the flange and further being adapted to fit over the shaft, and means for creating a fluid-tight seal between the flange and the sleeve as one turns relative to the other, said process comprising: removing the shaft from the casing; installing an arbor in the casing in lieu of the shaft, the arbor having a grinding wheel thereon and being supported in the casing on bearings that are in the bearing housings and are also capable of supporting the shaft, the arbor being supported such that the grinding wheel is located opposite to a casing surface that normally surrounds the shaft where the shaft emerges from the casing; rotating the arbor in the bearings, whereby the grinding wheel likewise revolves, and simultaneously forcing the rotating grinding wheel against the portion of the casing that it faces so as to grind a sealing surface into the casing, with the sealing surface completely surrounding the arbor; removing the arbor from the casing; installing a cartridge-type seal on the shaft; installing the shaft in the casing such that it is supported by the bearings and the bearings are in the bearing housings; and fastening the flange of the cartridge-type seal against the ground sealing surface.

14. The process according to claim 13 wherein the axial force that is applied to the grinding wheel is exerted through the arbor.

15. The process according to claim 13 wherein the casing is split into sections that are normally secured together; wherein the step of removing the shaft from the casing and the step of removing the arbor from the casing include separating the sections of the casing; and wherein the step of installing an arbor in the casing and the step of installing the shaft in the casing include fitting the sections of the casing together and securing them to each other.

16. The process according to claim 13 wherein the bearing housings and the bearings are located externally of the casing and are spaced from the region at which the shaft emerges from the casing; and wherein the step of installing the arbor in the casing includes fitting the grinding wheel between the casing and one of the bearings.

17. The process according to claim 13 wherein the face of the grinding wheel that bears against the casing is normal to the axis of the arbor, whereby the sealing surface is ground normal to the axis of the shaft.

18. The process according to claim 13 wherein the diameter of the arbor is smaller than the diameter of the shaft; and wherein the step of installing the arbor in the casing includes fitting bushings to the arbor so that the bearings will accommodate it without excessive radial clearance.

19. The process according to claim 13 wherein the casing is that of a centrifugal pump and the shaft has an impeller mounted on it.

20. The process according to claim 14 wherein the thrust is applied to the arbor through a thrust applicator including a mount, a lever that pivots on the mount and a thrust bearing that fits around the arbor, said process further including installing the thrust bearing on the arbor, installing the mount on the machine such that one end of the lever is opposite the thrust bearing, and applying a force near the other end of the lever such that the end which is at the thrust bearing is forced against the thrust bearing and the bearing transmits the force to the arbor.

21. The process according to claim 20 wherein the mount is installed on one of the bearing housings for the machine.

* * * * *

UNITED STATES PATENT AND TRADEMARK OFFICE

CERTIFICATE OF CORRECTION

PATENT NO. : 4,449,330

DATED : May 22, 1984

INVENTOR(S) : Cornelius J. McCarthy and George E. Aplin

It is certified that error appears in the above-identified patent and that said Letters Patent is hereby corrected as shown below:

On the title page the title should read: "RESURFACING PROCESS AND TOOL FOR INSTALLING CARTRIDGE-TYPE SEALS".

Column 1, lines 1 and 2, the title should read: "RESURFACING PROCESS AND TOOL FOR INSTALLING CARTRIDGE-TYPE SEALS".

Signed and Sealed this

*Ninth* Day of *October 1984*

[SEAL]

*Attest:*

*Attesting Officer*

GERALD J. MOSSINGHOFF

*Commissioner of Patents and Trademarks*